US008226439B2

(12) United States Patent
Lai

(10) Patent No.: US 8,226,439 B2
(45) Date of Patent: Jul. 24, 2012

(54) ELECTRICAL CONNECTOR

(75) Inventor: Ming-Chun Lai, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 32 days.

(21) Appl. No.: 12/870,819

(22) Filed: Aug. 28, 2010

(65) Prior Publication Data

US 2012/0052726 A1 Mar. 1, 2012

(51) Int. Cl.
*H01R 13/648* (2006.01)

(52) U.S. Cl. ..... 439/607.25; 439/607.23

(58) Field of Classification Search ..... 439/607.23–607.26, 607.55, 607.35, 541.5
See application file for complete search history.

(56) References Cited

U.S. PATENT DOCUMENTS 7,997,927 B2 * 8/2011 Wan et al. ..... 439/541.5
2005/0181671 A1 * 8/2005 Hu et al. ..... 439/607
* cited by examiner

*Primary Examiner* — Ross Gushi
(74) *Attorney, Agent, or Firm* — Cheng-Ju Chiang

(57) ABSTRACT

An electrical connector has an insulating housing. The insulating housing has a base. At least one positioning block is protruded from a front of the base and separates the base into several equal parts. A plurality of terminals is mounted into the insulating housing. A connecting element is fixed on the positioning block. A shielding shell wraps the insulating housing. The positioning block cooperates with the shielding shell to form receiving spaces for receiving plug connectors. So, the electrical connector is capable of receiving multiple plug connectors. Meanwhile, the electrical connector simplifies the soldering process while assembling multiple connectors, and also, improves the assembly accuracy.

20 Claims, 5 Drawing Sheets

ELECTRICAL CONNECTOR

BACKGROUND OF THE INVENTION

1. Field of the Invention

The present invention relates to an electrical connector, and particularly to an electrical connector capable of receiving multiple plug connectors.

2. The Related Art

As electrical products need to connect with various external devices, multiple electrical connectors are required on an electrical product. The connectors are usually assembled on the PCB (Printed Circuit Board) one by one as it is convenient in use. However, it is inconvenient to solder the connectors one by one, and it is also difficult to assemble the connectors at certain position. The connectors may be assembled at different height, which greatly influents the appearance of the product and affects customers' use.

SUMMARY OF THE INVENTION

Accordingly, an object of the present invention is to provide an electrical connector. The electrical connector has an insulating housing. The insulating housing has a base. At least one positioning block is protruded from a front of the base and separates the base into several equal parts. Each part has a supporting portion protruded from a front of the base. A plurality of terminals is mounted into the insulating housing. A connecting element fixed on the positioning block has a base slice. Two opposite sides of the base slice are extended rearward to form lateral slices. A shielding shell covering the insulating housing has a top plate, two opposite sides of the top plate bent downward to form a pair of lateral plates, a bottom plate facing the top plate. A rear of the top plate is extended rearward to form a rear plate. The rear plate is bent downward to wrap the insulating housing in assembly. The positioning block cooperates with the shielding shell to form receiving spaces for receiving plug connectors.

As described above, at least one the positioning block divides the insulating housing into several parts. The positioning block cooperates with the shielding shell to form several receiving spaces for receiving plug connectors. So, the electrical connector is capable of receiving multiple plug connectors. Meanwhile, the electrical connector simplifies the soldering process while assembling multiple connectors, and also, improves the assembly accuracy.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
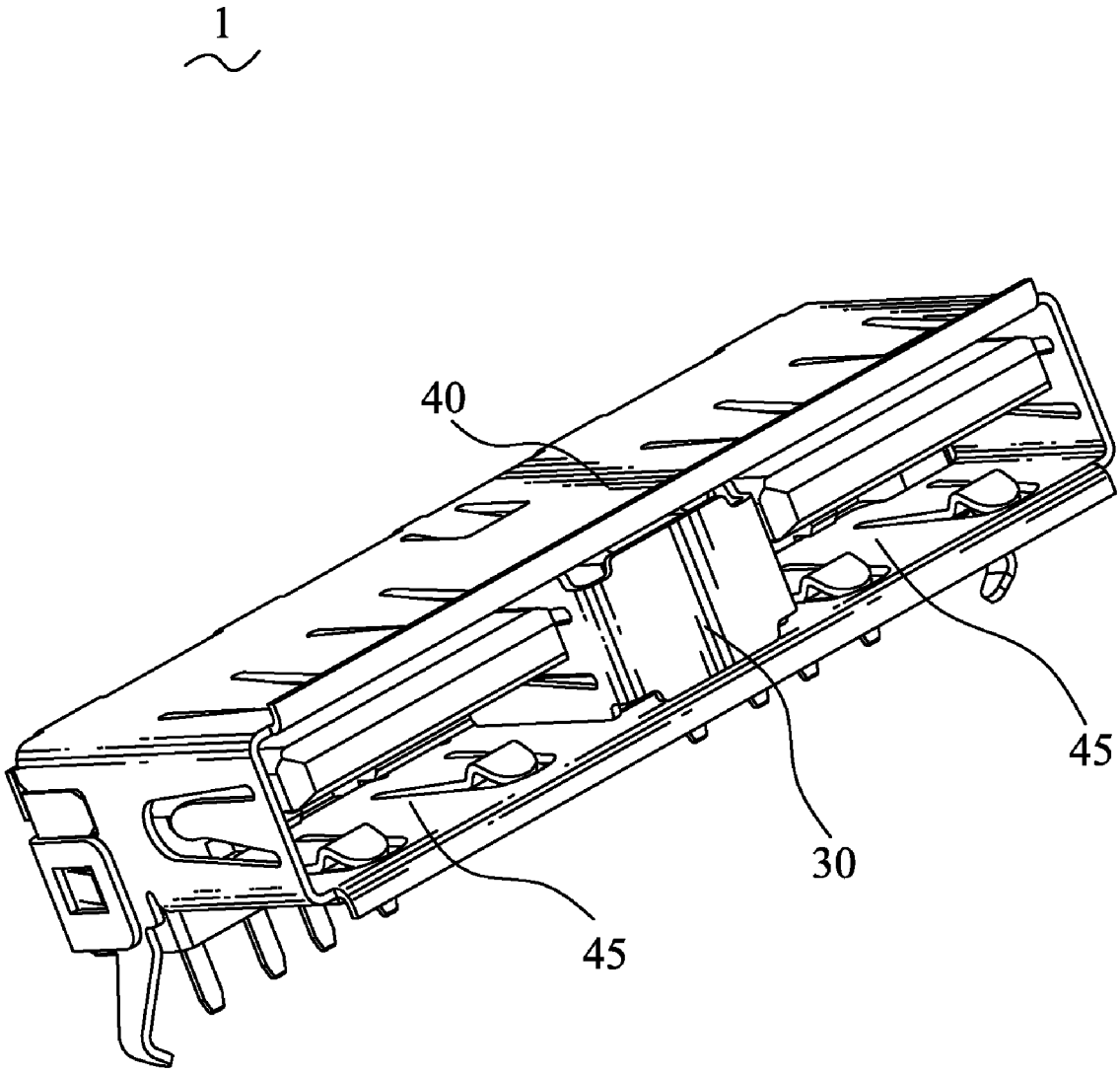
FIG. 1 is an assembled, perspective view of an electrical connector of an embodiment in accordance with the present invention.
Figure 2:
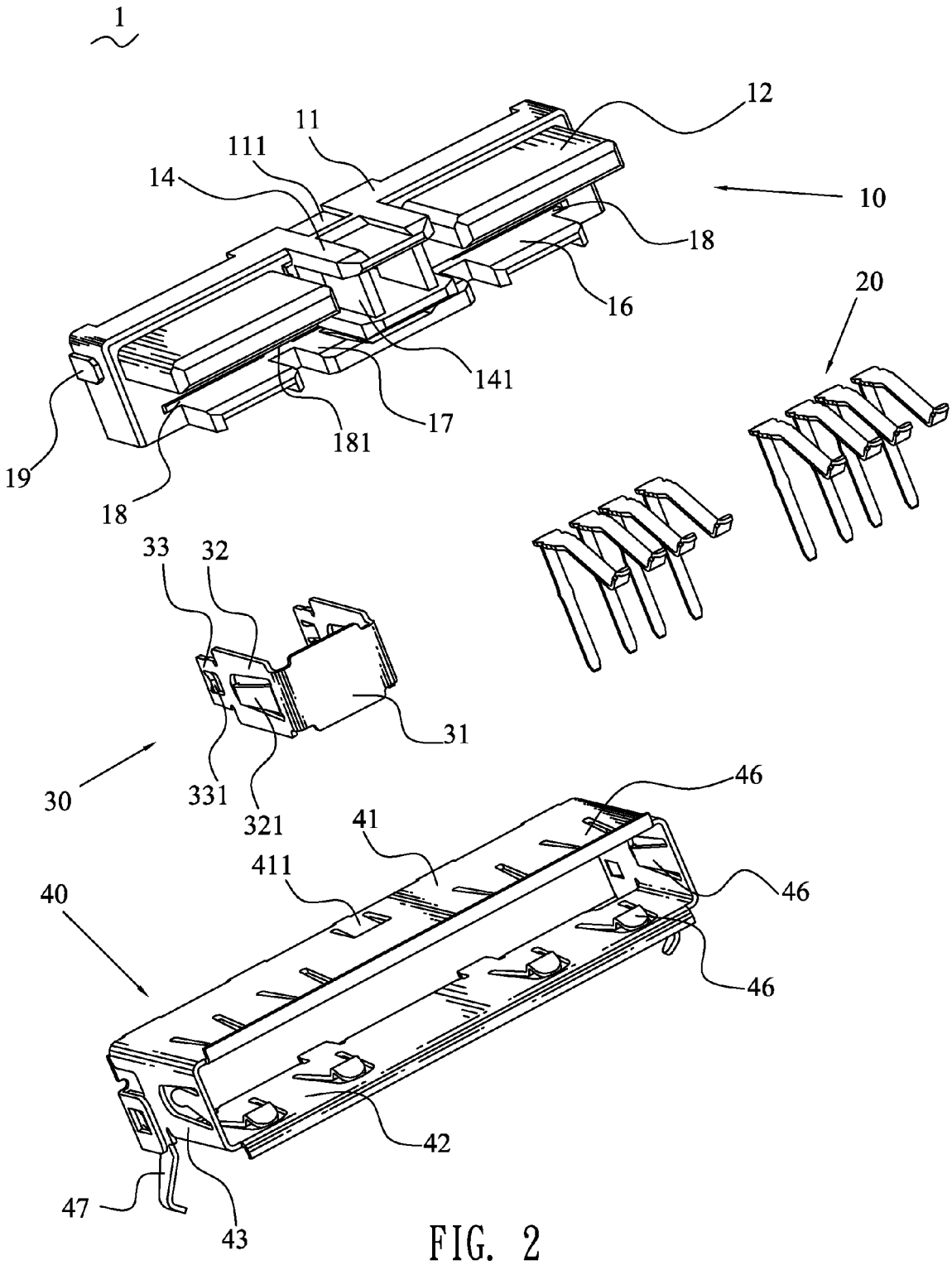
FIG. 2 is an exploded, perspective view of the electrical connector shown in FIG. 1.

Referring to the drawings in greater detail, and first to FIGS. 1-2, the embodiment of the invention is embodied in an electrical connector 1. The electrical connector 1 includes an insulating housing 10, a plurality of terminals 20 mounted into the insulating housing 10, a connecting element 30 fixed on the insulating housing 10, a shielding shell 40 covering the insulating housing 10.

Figure 3:
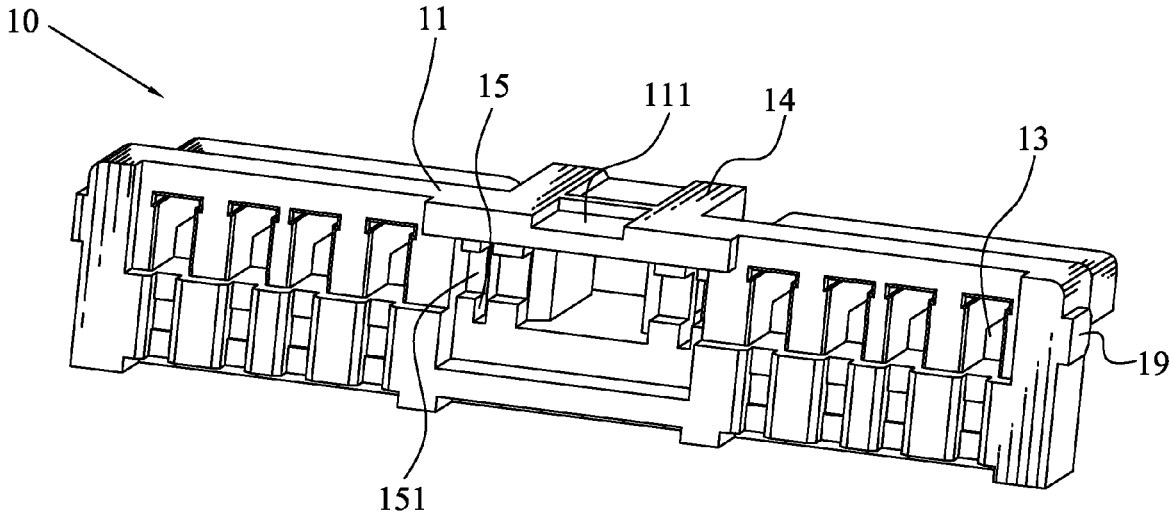
FIG. 3 is a rear view of an insulating housing of the electrical connector shown in FIG. 2.
Figure 4:
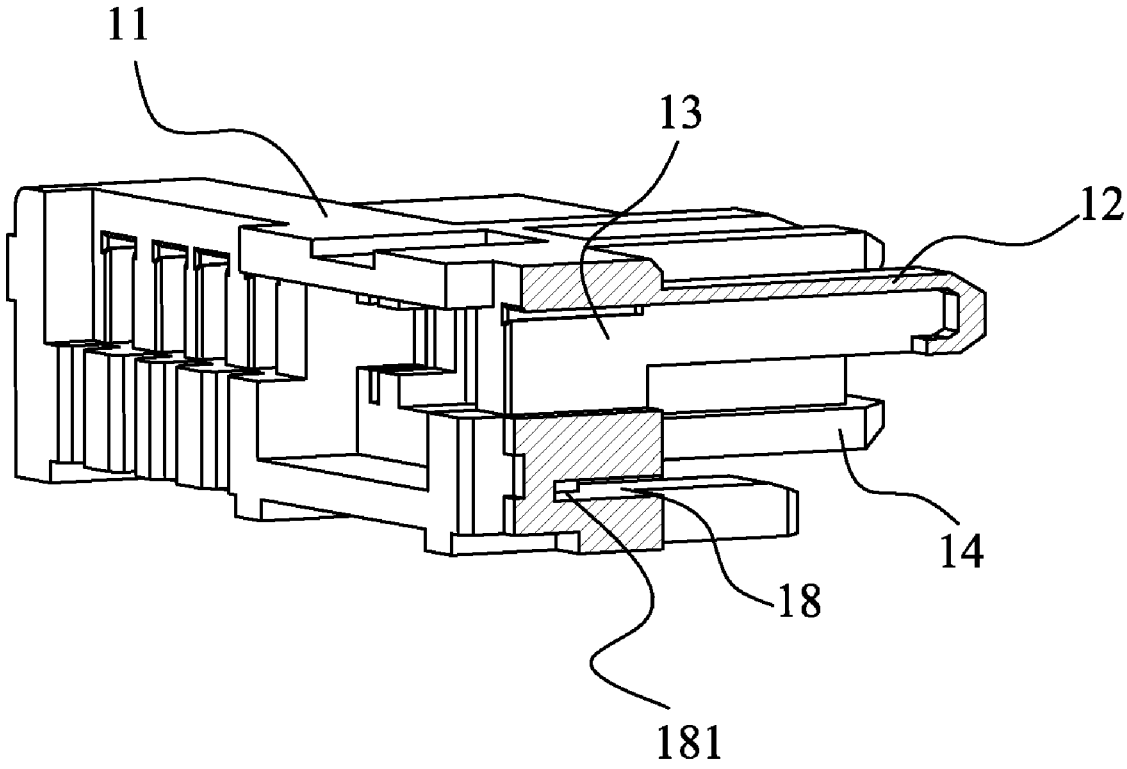
FIG. 4 is a cross-sectional view of the insulating housing shown in FIG. 3.

With reference to FIGS. 2-4, the insulating housing 10 has a rectangular base 11. A top side of the base 11 is recessed to form a buckling recess 111 with a close end adjacent to a front surface of the base 11. The base 11 has a rectangular positioning block 14 protruded from a middle of the front surface thereof. A top of the positioning block 14 is level with that of the base 11. Two lateral sides of the positioning block 14 are recessed to form receiving recesses 141 at a substantially middle portion thereof. The positioning block 14 divides the front surface of the base 11 into two parts. Each part has a tongue 12 and a supporting portion 16 protruded frontward. The supporting portion 16 locates at a lower position than the tongue 12 and is parallel to the tongue 12. A supporting plate 17 is protruded from a position lower than the positioning block 14. The supporting plate 17 locates between two supporting portions 16 and level with the supporting portions 16. A bottom side of the tongue 12 is recessed to form a plurality of terminal grooves 13 extending frontward and rearwards for receiving the terminals 20. A pair of through recesses 15 located beside both lateral sides of the positioning block 14 extends through the base 11 along a front-to-rear direction. A rear of the through recess 15 is extended along a direction perpendicular to the through recess 15 to form a slot 151. A fixing slot 18 is recessed at a portion of the front surface of the base 11 adjacent to tops of the supporting portions 16 and the supporting plate 17 with closed ends adjacent to the two opposite sides of the base 11. A plurality of fixing protrusions 181 is extended downward from a top of the fixing slot 18. Each lateral side of the base 11 is protruded to form a protrusion 19.

Referring to FIG. 2, the connecting element 30 made of metal is fixed on the positioning block 14. The connecting element 30 has a rectangular base slice 31. Two opposite sides of the base slice 31 are extended perpendicularly to form a pair of facing lateral slices 32. A middle portion of the lateral slice 32 is punched to form a connecting slice 321 slanting outward. A middle of a rear portion of the lateral slice 32 is extended rearward to form a fixing slice 33. The fixing slice 33 has a stab 331 slanting inward. In assembly, the connecting element 30 is fixed on the positioning block 14 with the fixing slice 33 pushed into the through recess 15. The stab 331 buckles with the slot 151 for fixing the connecting element 30 firmly on the positioning block 14. The connecting slice 321 slants outward for being elastically against the plug connector and goes into the receiving recess 141 when a plug connector is inserted into the electrical connector 1.

Figure 5:
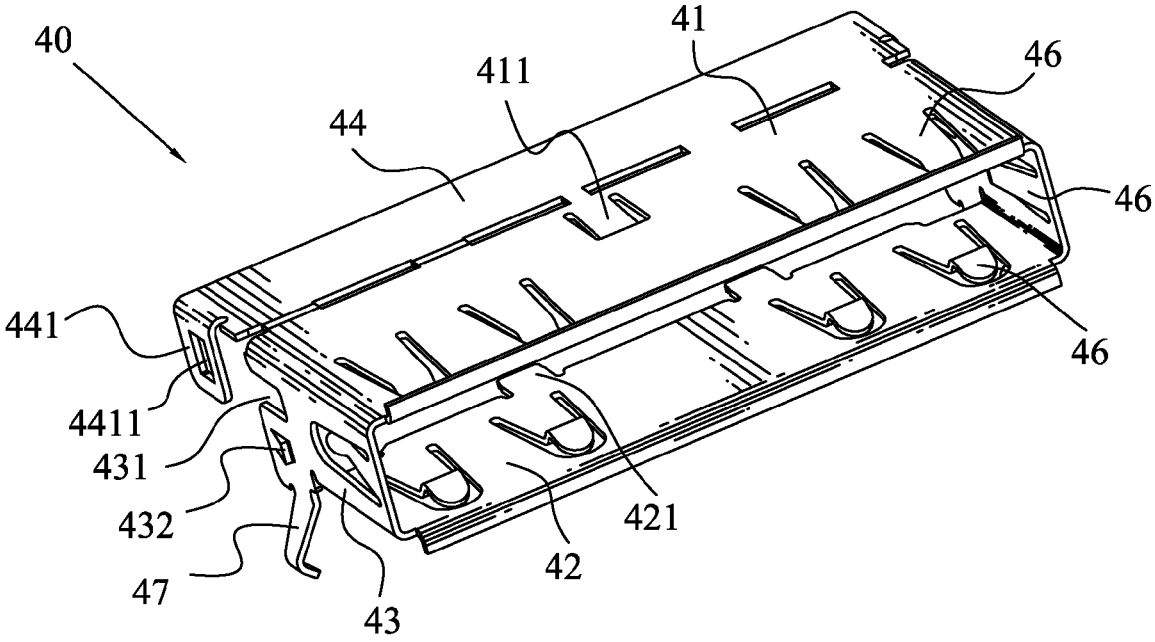
FIG. 5 is a perspective view showing an initial state of a shielding shell that had not been assembled into the insulating housing.

Please refer to FIGS. 1-2 and FIG. 5, the shielding shell 40 has a top plate 41 and a bottom plate 42 facing the top plate 41. Two opposite sides of the top plate 41 are extended downward to form a pair of lateral plates 43. A rear of the top plate 41 is extended rearward to form a rear plate 44. Two opposite sides of the rear plate 44 are extended downward to form a pair of buckling plates 441. The buckling plate 441 has a mating opening 4411 at a center thereof. A rear portion of the lateral plate 43 is recessed to form a receiving recess 431 with an open rear end. A bump 432 is protruded outward from a portion of the lateral plate 43 below the receiving recess 431. A bottom side of the lateral plate 43 extends downward to form a fixing leg 47 having a free end arced outward to buckle with the PCB for fixing the electrical connector 1 on the PCB firmly. A rear side of the bottom plate 42 is extended rearward to form a plurality of fixing portions 421. A plurality of elastic pieces 46 is punched on the top plate 41, two lateral plates 43 and the bottom plate 42. The positioning block 14 and the tongues 12 cooperate with the shielding shell 40 to form two receiving spaces 45 for receiving plug connectors.

In assembly, the connecting element 30 is fixed on the positioning block 14. The insulating housing 10 is inserted into the shielding shell 40. The rear plate 44 is bent downward to wrap a rear of the base 11 and is fixed on the lateral plate 43 by means of the bump 432 buckling with the mating opening 4411. The protrusion 19 is received into the receiving recess 431 for preventing the insulating housing 10 moving frontward. The buckling piece 411 is received in the buckling recess 111 for preventing the insulating housing 10 moving rearward. The bottom plate 42 is supported by two supporting portions 16 and the supporting plate 17. The fixing portion 421 is inserted into the fixing slot 18 and hold by the fixing protrusion 181. When a plug connector is inserted into the electrical connector 1, the elastic pieces 46 and the connecting slice 321 rest against the plug connector to provide a steady connection.

As described above, the positioning block 14 divides the insulating housing 10 into two parts. The positioning block 14 and the tongues 12 cooperate with the shielding shell 40 to form two receiving spaces 45 for receiving plug connectors. So, the electrical connector 1 is capable of receiving multiple plug connectors. Meanwhile, the electrical connector 1 simplifies the soldering process while assembling multiple connectors, and also, improves the assembly accuracy.

What is claimed is:

1. An electrical connector fixed on a printed circuit board (PCB) capable of receiving multiple plug connectors, comprising:

an insulating housing having a base, at least one positioning block protruded from a front of the base separating the base into multiple parts;

a plurality of terminals mounted into the insulating housing;

a connecting element fixed on the positioning block having a base slice attached to a front of the positioning block, two opposite sides of the base slice extended rearward to form lateral slices attached to two lateral sides of the positioning block for electrically connecting with the inserted plug connectors; and a shielding shell covering the insulating housing having a top plate, two opposite sides of the top plate bent downward to form a pair of lateral plates, a bottom plate facing the top plate, a rear of the top plate extended rearward to form a rear plate which is bent downward to wrap the insulating housing, the positioning block cooperating with the shielding shell to form receiving spaces for receiving plug connectors;

wherein at least one supporting portion is protruded from a lower position of the front of the base, and a supporting plate is protruded from a lower position of the front of the base than the positioning block, for supporting the bottom plate of the shielding shell.

2. The electrical connector as claimed in claim 1, wherein each part of the base divided by the positioning block has a tongue protruded frontward accommodated in the receiving space, the tongue has a plurality of terminal grooves formed thereon for receiving terminals.

3. The electrical connector as claimed in claim 1, wherein the lateral slice is punched outward to form a connecting slice for being elastically against one side of the plug connector, a lateral side of the positioning block is recessed to form a receiving recess for receiving the connecting slice when the connecting slice is pushed by the plug connector.

4. The electrical connector as claimed in claim 1, wherein a top side of the base is recessed to form a buckling recess mating with a buckling piece formed at the top plate of the shielding shell for preventing the insulating housing moving rearward.

5. The electrical connector as claimed in claim 1, wherein a lateral side of the base is protruded to form a protrusion received in a receiving recess formed at a rear portion of the lateral plate of the shielding shell for preventing the insulating housing moving frontward.

6. The electrical connector as claimed in claim 1, wherein two opposite sides of the rear plate are extended perpendicularly to form a pair of buckling plate, each buckling plate has a mating opening formed at a center thereof for mating with a bump protruded from the lateral plate for fixing the rear plate on the lateral plate.

7. The electrical connector as claimed in claim 1, wherein a plurality of elastic pieces is punched inward on the top plate, two lateral plates and the bottom plate to rest against the plug connector for providing a steady connection when the plug connector is inserted into the electrical connector.

8. The electrical connector as claimed in claim 1, wherein a bottom side of the lateral plate is extended downward to form a fixing leg for fixing the electrical connector on the PCB.

9. The electrical connector as claimed in claim 8, wherein the fixing leg has a free end arced outward buckling with the PCB.

10. An electrical connector fixed on a printed circuit board (PCB) capable of receiving multiple plug connectors, comprising:

an insulating housing having a base, at least one positioning block protruded from a front of the base separating the base into multiple parts;

a plurality of terminals mounted into the insulating housing;

a connecting element fixed on the positioning block having a base slice attached to a front of the positioning block, two opposite sides of the base slice extended rearward to form lateral slices attached to two lateral sides of the positioning block for electrically connecting with the inserted plug connectors; and a shielding shell covering the insulating housing having a top plate, two opposite sides of the top plate bent downward to form a pair of lateral plates, a bottom plate facing the top plate, a rear of the top plate extended rearward to form a rear plate which is bent downward to wrap the insulating housing, the positioning block cooperating with the shielding shell to form receiving spaces for receiving plug connectors;

wherein a plurality of fixing portions extended rearward from a rear of the bottom plate is received in a fixing slot recessed at the front of the base and hold by a plurality of fixing protrusion extended downward from a top of the fixing slot.

11. The electrical connector as claimed in claim 10, wherein each part of the base divided by the positioning block has a tongue protruded frontward accommodated in the receiving space, the tongue has a plurality of terminal grooves formed thereon for receiving terminals.

12. The electrical connector as claimed in claim 10, wherein the lateral slice is punched outward to form a connecting slice for being elastically against one side of the plug connector, a lateral side of the positioning block is recessed to form a receiving recess for receiving the connecting slice when the connecting slice is pushed by the plug connector.

13. The electrical connector as claimed in claim 10, wherein a top side of the base is recessed to form a buckling recess mating with a buckling piece formed at the top plate of the shielding shell for preventing the insulating housing moving rearward.

14. The electrical connector as claimed in claim 10 wherein a lateral side of the base is protruded to form a protrusion received in a receiving recess formed at a rear portion of the lateral plate of the shielding shell for preventing the insulating housing moving frontward.

15. The electrical connector as claimed in claim 10, wherein a bottom side of the lateral plate is extended downward to form a fixing leg for fixing the electrical connector on the PCB.

16. An electrical connector fixed on a printed circuit board (PCB) capable of receiving multiple plug connectors, comprising:

an insulating housing having a base, at least one positioning block protruded from a front of the base separating the base into multiple parts;

a plurality of terminals mounted into the insulating housing;

a connecting element fixed on the positioning block having a base slice attached to a front of the positioning block, two opposite sides of the base slice extended rearward to form lateral slices attached to two lateral sides of the positioning block for electrically connecting with the inserted plug connectors; and a shielding shell covering the insulating housing having a top plate, two opposite sides of the top plate bent downward to form a pair of lateral plates, a bottom plate facing the top plate, a rear of the top plate extended rearward to form a rear plate which is bent downward to wrap the insulating housing, the positioning block cooperating with the shielding shell to form receiving spaces for receiving plug connectors; wherein a pair of through recesses are formed beside both sides of the positioning block extending through the base, each of the through recesses intended for receiving a fixing slice extended from a middle of a rear of the lateral slice, and a rear of the positioning block forms a slot extending along a direction perpendicular to the through recess and communicating with the through recess for buckling with a stab slanting inward on the fixing slice to fix the connecting element on the positioning block firmly.

17. The electrical connector as claimed in claim 16, wherein each part of the base divided by the positioning block has a tongue protruded frontward accommodated in the receiving space, the tongue has a plurality of terminal grooves formed thereon for receiving terminals.

18. The electrical connector as claimed in claim 16, wherein the lateral slice is punched outward to form a connecting slice for being elastically against one side of the plug connector, a lateral side of the positioning block is recessed to form a receiving recess for receiving the connecting slice when the connecting slice is pushed by the plug connector.

19. The electrical connector as claimed in claim 16, wherein a top side of the base is recessed to form a buckling recess mating with a buckling piece formed at the top plate of the shielding shell for preventing the insulating housing moving rearward.

20. The electrical connector as claimed in claim 16, wherein a bottom side of the lateral plate is extended downward to form a fixing leg for fixing the electrical connector on the PCB.

* * * * *